US005676032A

United States Patent [19]

Johnson

[11] Patent Number: 5,676,032

[45] Date of Patent: Oct. 14, 1997

[54] STEEL RULE DIE WITH CLOSELY NESTED CAVITIES

[75] Inventor: Michael J. Johnson, El Paso, Tex.

[73] Assignee: Southwest Die Corporation, El Paso, Tex.

[21] Appl. No.: 545,929

[22] Filed: Oct. 20, 1995

[51] Int. Cl.[6] ..... B26F 1/44

[52] U.S. Cl. ..... 83/697; 83/55; 83/698.91; 83/652; 83/97

[58] Field of Search ..... 83/698.91, 652, 83/697, 695, 684, 685, 55, 911, 683, 682; 225/97

[56] References Cited

U.S. PATENT DOCUMENTS

| | | | |
|---|---|---|---|
| 1,177,005 | 3/1916 | Zimmerman . | |
| 1,321,896 | 11/1919 | Davis . | |
| 2,097,693 | 11/1937 | Foster . | |
| 2,313,801 | 3/1943 | Carll | 83/698.91 |
| 3,205,750 | 9/1965 | Strange | 83/695 |
| 3,335,628 | 8/1967 | Simms et al. . | |
| 3,411,208 | 11/1968 | Malm | 83/692 |
| 3,599,520 | 8/1971 | Wood | 83/55 |
| 3,626,799 | 12/1971 | Gerber et al. | 83/697 |
| 3,826,170 | 7/1974 | Jones et al. | 83/652 |
| 4,601,228 | 7/1986 | Steadman et al. . | |
| 4,754,677 | 7/1988 | McKindary | 83/697 |
| 4,829,854 | 5/1989 | Kammerling-Essmann . | |
| 4,921,154 | 5/1990 | Abe et al. | 225/97 |
| 4,981,061 | 1/1991 | Hillock et al. | 83/697 |
| 5,129,295 | 7/1992 | Geffros et al. . | |
| 5,402,698 | 4/1995 | Morrison | 83/55 |

FOREIGN PATENT DOCUMENTS

| | | | |
|---|---|---|---|
| 4304030 | 8/1994 | Germany | 83/684 |
| WO 8906184 | 7/1989 | WIPO | 83/684 |

*Primary Examiner*—Maurina T. Rachuba
*Attorney, Agent, or Firm*—Banner & Witcoff, Ltd.

[57] ABSTRACT

A steel rule cutting die for cutting fixed patterns in a single or plurality of stacked material layers according to the shape of the steel rule. The invention provides for a decrease in the quantity of scrap material produced, by minimizing the amount of gap between adjacent cavities in the steel rule cutting die. Pre-sharpened steel rule is used with the cutting edge shifted to the outboard side of the cavity thus reducing the amount of compression or wedging of scrap material between adjacent cavities, and thus allowing adjacent cavities to be positioned closer to one another or to contact one another without reducing the ability to remove the scrap material after the cutting operation. Frayed scrap material can be evacuated through the base of the die by providing evacuation holes in the base substrate of the die as well as providing for evacuation of scrap material from marker notch locations along joined sections of adjacent cavities. A variety of cavity shapes can be accommodated.

11 Claims, 10 Drawing Sheets

STEEL RULE DIE WITH CLOSELY NESTED CAVITIES

FIELD OF THE INVENTION

This invention relates to steel rule cutting dies, and more particularly to improved method steel rule cutting dies with a reduced gap between adjacent cavities of multi-cavity dies so as to reduce the amount of material scrap.

BACKGROUND OF THE INVENTION

Steel rule cutting dies are commonly used for cutting cloth, cloth like materials such as natural textiles and synthetic materials such as vinyl, and other materials. Steel rule dies are particularly advantageous in the repetitive cutting of specific shapes for use in clothing, furniture, and automotive interior panels. In brief, a steel rule cutting die typically comprises a base substrate or backing board in which a groove matching the desired pattern to be cut is formed or otherwise provided. A length of sharpened blade, known as a steel rule, is formed to the shape of the desired pattern to be cut and is embedded in the corresponding groove in the board. The steel rule has a sharpened cutting edge extending away from the board. The die is used in conjunction with a cutting table and a press which may be either single cut or progressive feed. A single steel rule cutting die is often constructed with multiple blades or cavities as to enable cutting of multiple patterns with a single pass through the press. Multiple cavities or patterns can be nested together on the substrate in an efficient configuration to minimize scrap. Adjacent cavities of the die must be separated from one another by a gap sufficiently large to allow for scrap material to be removed from the gap after the cutting operation is complete. It is general practice in the die cutting industry to use a gap of 0.25 inches or more. However, using a gap of 0.25 inches or more causes significant scrap of wasted unused material. Accordingly, a reduction in scrap, and thus cost, could be attained by either reducing or completely eliminating this gap between cavities.

In existing multi-cavity dies, a certain amount of waste is produced due to the gap between adjacent cavities. The gap between cavities is used because of the bevel on the sharpened portion of the rule. As the rule cuts through several layers of material, the material is compressed laterally by the thickness of the rule. If two cavities are placed next to each other with too small of a gap, the scrap material between the cavities will be compressed into the gap and become stuck. Thus, existing multi-cavity dies have not been able to successfully reduce the gap between cavities to less than 0.25 inches in conventional dies.

Steel rule dies are used in applications where a large number of pieces are required so that repetitive cuts can be automated. Because of the large number of pieces, even a small amount of scrap material per piece can add up to a large waste for the manufacturer. For instance, a typical manufacturer of automotive interior panels may produce interior trim panels for 1,000,000 cars per year. This amounts to approximately 6,000,000 yards of material per year. The average material cost may be $8.50 per yard yielding an annual cost of $51,000,000 for material alone. If the gap between adjacent cavities could successfully be reduced from 0.25 inches to 0.125 inches, typical savings in the range of 2–5% can be achieved. In the above example, this would equate to an annual savings of $1,020,000 to $2,550,000 for the typical automotive interior panel manufacturer. It can therefore be seen that it would be desirable to reduce or eliminate the gap between adjacent cavities.

Prior attempts to reduce or eliminate the gap between cavities have not proven successful and the general practice in the industry continues to be a 0.25 inches gap. Prior attempts at reducing or eliminating the gap have been complex and cumbersome, difficult to clean, have resulted in weakened rule in the area of the gaps or have not been suitable for large or complex patterns. One method that has been used to eliminate the gap is to use a single piece of cutting knife on straight sections of adjoining cavities. Use of a single common knife section, however, is not possible on irregular shapes.

One approach to eliminating the gap between adjacent cavities of a cutting device is disclosed in U.S. Pat. No. 1,321,896. This patent describes the manufacture of a cutting die in one continuous piece with irregular shaped cavities sharing common sections of cutting blade. This concept suffers from the fact that all cavities must be formed from a solid piece at the joining locations, and are inseparably connected making it impractical for larger dies such as those used in cutting parts for automobile interiors and furniture, as well as making repair difficult or impossible.

Another approach to eliminating the gap between adjacent cavities of a cutting device is disclosed in U.S. Pat. No. 1,177,005. This patent describes the use of a grouping frame to position adjacent cavities of a cutting die so as to contact one another. The concept suffers from the fact that the grouping frame adds complexity and thus cost to the apparatus. Further, the apparatus may need to be disassembled between consecutive cutting operations to clean scrap or waste material from the apparatus, thus decreasing the productivity and raising the cost of using such an apparatus.

In neither of the above mentioned patents is there mention of device for accommodating evacuation of scrap from the substrate of a steel rule die or cutting marker notches on the common sections of the die. Nor is a device for reducing without eliminating the gap between cavities discussed. Nor do they encompass steel rule cutting dies or dies fabricated with presharpened blade.

SUMMARY OF THE INVENTION

According to the present invention, the gap of 0.25 inches between adjacent cavities, which is general practice in the industry, is reduced or completely eliminated by using rule with the cutting edge offset toward the outer edge of the cavity. It has been found that the ability to remove scrap material from between adjacent cavities is dependent on the percentage of cross sectional reduction that the material undergoes during the cutting operation. Through the offset of the cutting edge, the amount of material wedged between cavities is reduced, and thus the distance between cavities can be reduced to less than 0.25 inches. In order to accommodate the fact that the cutting edge has been shifted from the center of the rule, the groove in the board is also offset by the same amount so that the cut piece is the correct size.

If the cutting edge of the rule is offset all the way to the outside of the rule, then two sections of rule can directly contact each other with their cutting edges back to back. In this way, no material will be wedged between the cavities and the gap between cavities can be completely eliminated. In the common areas of contact between two cavities with side bevel rule, the two sections of rule can be joined using a variety of techniques including welding, silver soldering, brazing, riveting, or a combination of these techniques.

Using two pieces of side bevel rule to eliminate the gap between cavities has several advantages over using a single piece of common rule between cavities. Complex shapes can be accommodated wherein the adjacent cavities touch each other only at one point. It is also possible to have two adjacent cavities touch each other at several points with the patterns diverging from each other in between contact points. Use of individual side bevel rule cavities also allows for easier cleaning and maintenance than does a common piece of rule attached to two adjacent cavities.

The amount of gap to be left between adjacent cavities, if any, is dependent on the specific application and on the type and cost of material being cut. A die is in no way limited to having all cavities using either the reduced gap technique or the butted cavity technique. Rather, it has been found that using a combination of the two types of gap may be the best approach in some circumstances.

Another aspect of the present invention is the provision for evacuation of scrap materials in areas where small angles are formed between two adjacent sections of rule. When adjacent cavities are butted and small angles are formed as the knives diverge, some frayed material can build up in the small crevice formed by the diverging knives. In order to allow evacuation of this scrap material, a small portion of the base or substrate material can be removed to allow an exit path for the material. In addition, the base of the cutting knife, inside the substrate, can be cut away or relieved, further aiding in the evacuation of the scrap material.

A further aspect of the present invention is the manner of providing marker notches in the pattern being cut. Marker notches are frequently used in patterns to give a small notch in the cut material. These notches indicate where the material is to be folded or they can allow two pieces of material to be aligned while being sewn together. If a marker notch is to be placed in a position where two sections of rule are closely adjacent each other or butted against each other, allowance should be made for evacuation of the extra material cut by the marker notch. Several types of marker notches are contemplated by the present invention.

The first type of marker notch is bent or formed in the full depth of the steel rule prior to joining adjacent cavities thereby allowing scrap material to be ejected from the rear of the cutting die with consecutive cuts. In this case the portion of the substrate under the marker notch must be removed to allow scrap material to pass through. This type of marker notch can be used with either the reduced gap or the butted cavity techniques.

The second type of marker notch is made by forming the notch only in the upper portion of the cutting blade prior to joining the adjacent cavities. Prior to forming the notch, an evacuation hole is made in the blade just below the area to be formed. The section of rule to be notched is then heated and formed using a forming tool. The forming tool enters the steel with an upward motion so that it forces the cutting edge upwards as the knife is formed. Forming the notch in this manner ensures that the cutting edge does not dip during the forming operation which would cause incomplete cuts at the notch locations. The forming tool is made in an irregular configuration so as to bite into the steel while forming it with the upward motion, thus preventing the forming tool from sliding up the knife edge. The formed notch can then be relieved below the knife edge, and the evacuation hole ground at an angle to allow for smooth evacuation of the scrap pieces. After the cavities are butted together, the mating area around the hole is sealed to the adjacent cavity using a suitable arrangement. This prevents scrap material from being wedged between the two adjacent cavities. This type of notch causes scrap material to be evacuated to the top of the die rather than out the bottom as with the previous method.

This notch technique is also used to form notches in nonjoined areas of the die with the elimination of the exhaust hole. It is also used in areas where the knives are diverging from a joined area. In this situation the bottom section of the exhaust hole is sharpened such that as the cut material is forced down past the notch, the notch is cut by sharpened hole, causing the notch portion of the scrap to be exhausted to the top of the die.

On long common edges, fabrication can be simplified by eliminating one of the pieces of steel and joining the cavities at the intersection points at each end of the common area. Notches are accommodated by joining small pieces of steel with notches formed into them, as explained above with the side outlet holes, at the notch locations. For straight sections opposite notches in adjacent cavities, small pieces of straight steel are joined opposite the notch leaving a straight section in the cavity and a notch in the adjacent cavity.

Another aspect of the invention allows for wandering gaps where two adjacent cavities contact each other at several locations and diverge in between contact locations. Wandering gaps in the steel are accommodated by removing the base substrate material between the two cavities and relieving the base of the steel between the cavities, allowing the scrap material to be ejected from the rear of the die. For longer sections, small pieces of steel rule can be joined across the gap every 3 to 6 inches along the cavity. These small pieces of steel serve to maintain the strength of the die as well as to cut the scrap material to be ejected from the rear of the die into smaller pieces which are more easily ejected.

The steel rule is attached to the substrate by cutting a groove in the substrate and inserting the rule into the notch. The groove should not be cut into the substrate over the entire periphery of a pattern or the center part of the pattern would be unsupported. Therefore bridges of substrate should be left in place and the steel rule should be cut away to fit over the bridges. The bridges maintain the integrity of the base substrate. The bridges of adjacent cavities should be aligned to maintain the strength of the board. The bridges may also be made larger than what is normally used to further enhance the integrity of the board.

The location of the groove in the substrate that holds the rule should be shifted by a certain amount to account for the offset bevel in the rule. To account for the shift in the location of the groove, the groove should be cut with great accuracy. In order to facilitate accurate cutting of the offset pattern in the base substrate, it is preferred to use a computer controlled cutting apparatus. The cutting apparatus preferably consists of an X-Y gantry system that supports and accurately positions a router driven rotary cutting tip. The X-Y gantry system allows the cutter to traverse the substrate in the shape of the patterns to be cut. The cutter can be lowered to cut the grooves and raised to leave the bridges in the substrate. Cuts with such a table can easily be controlled to within ±0.010 inches as required for the shifting of the groove locations. Such a level of accuracy is difficult to obtain with conventional manual cutting techniques.

Another aspect of the present invention is the use of ejection foam. In order to facilitate proper ejection of the cut patterns from the cavities and the scrap from between the cavities, foam is installed inside and around all cavities. It has been found that both open and closed cell foam with an Indentation Force Deflection (IFD) between 130 & 165 has yielded acceptable results.

It is an objective of the present invention to provide a multi-cavity steel rule die with adjacent cavities spaced less than 0.25 inches from each other.

It is a further objective of the present invention to provide a multi-cavity steel rule die wherein adjacent cavities contact each other in one or more locations.

It is a further objective of the present invention to provide a multi-cavity steel rule die with complex shaped cavities that come in and out of close proximity or contact with each other at several locations and diverge away from each other in between these locations.

It is a further objective of the present invention to provide a multi-cavity steel rule die with adjacent cavities in close proximity or contact with each other in which material is easily expelled after a cutting operation.

It is a further objective of the present invention to provide a multi-cavity steel rule die that can be easily cleaned and repaired.

It is a further objective of the present invention to provide a multi-cavity steel rule die that include marker notches on portions of the steel rule where adjacent cavities are in close proximity or in contact with each other.

The foregoing and other objects and advantages of the invention will be more fully understood from the following detailed description of the invention and from the accompanying drawings.

DETAILED DESCRIPTION OF THE PREFERRED EMBODIMENT

Figure 1A:
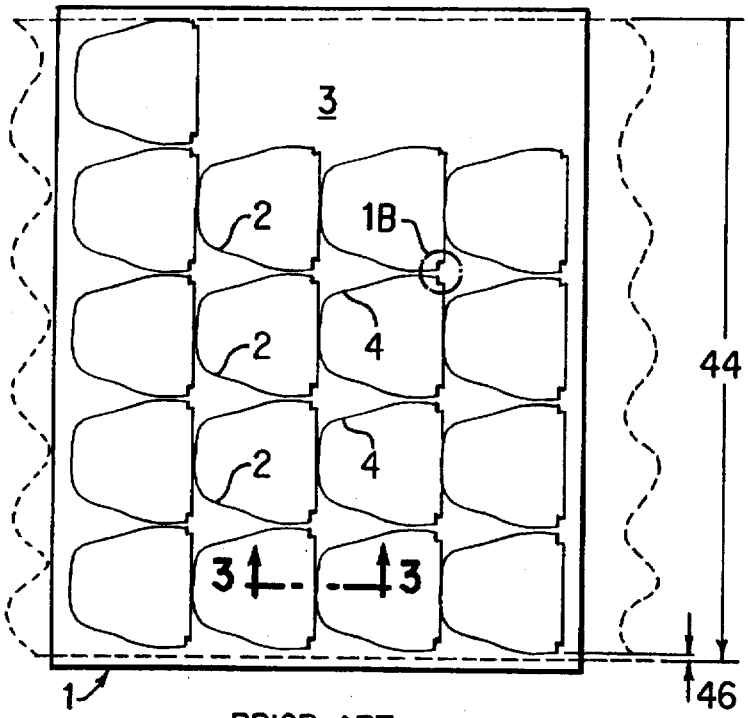
PRIOR ART FIG. 1A
FIG. 1A is a plan view of a prior art die with adjacent cavities spaced by a 0.25 inches gap which is typical in the general practice in the industry.
Figure 1B:
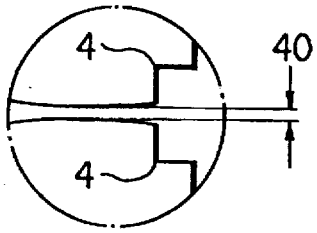
PRIOR ART FIG. 1B
FIG. 1B is a detailed view taken within circle 1B of FIG. 1A.
Figure 2A:
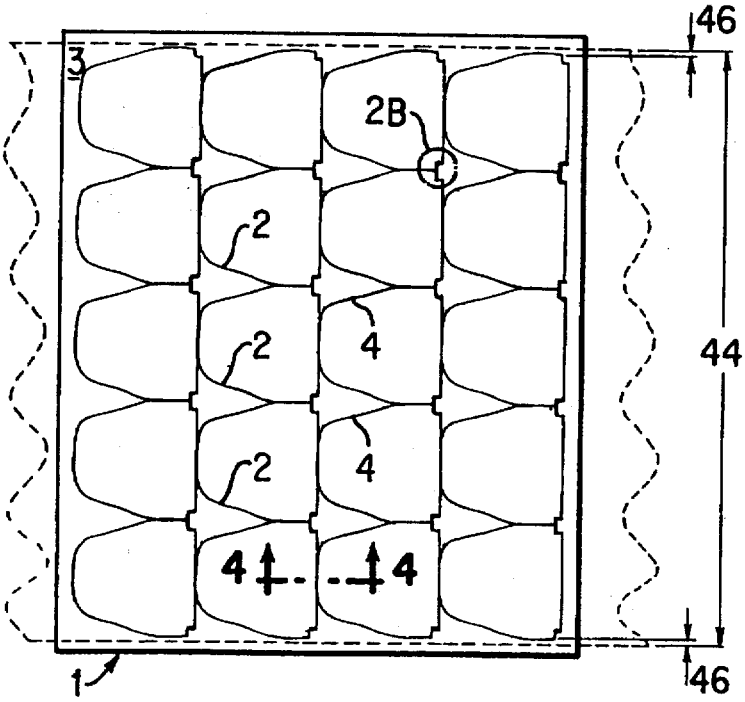
FIG. 2A is a plan view of a die using smaller gaps between adjacent cavities according to the present invention.

One of the main features of the invention allows adjacent cavities on a multi-cavity die to be nested more tightly with each other. The effect of tighter nesting according to the invention can be understood with reference to FIGS. 1A and 2A. FIGS. 1A and 2A show a die 1 with several cavities 2 mounted to a substrate 3. Each cavity 2 is made of a length of steel rule 4 that is attached to the substrate. The steel rule 4 is sharpened so that when the die is placed into a press it can cut patterns in the shape of cavities 2 into a stack of material. The difference between FIGS. 1A and 1B, and 2A and 2B, is that in FIGS. 1A and 1B, the gap 40 between cavities which is commonly used in the industry is 0.25 inches and in FIGS. 2A and 2B, the cavities are spaced by a gap 42 of 0.0625 inches so that the cavities can be more tightly spaced.

In the example shown in FIGS. 1A and 2A, the substrate 3 has a usable width 44 of, for example, 60 inches. The usable width of each substrate is determined by the width of the material go be cut. Material is bought in standard width bolts. Thus, the width of the die is fixed and is not a design variable when designing a die. A certain amount of overhang space 46 must be left on the sides of the die to allow for misalignment of stacked layers of material on the die. A typical overhang space 46, as shown in FIGS. 1A and 2A, can be 0.5 inches. The overhang space is a fixed dimension and is also not a design variable when designing a die. Each cavity 2 of the die has a width of, for example, 11.7 inches. In this example, the combined width of five cavities is 58.5 inches. The substrate 3 would have room to fit five cavities side by side across its width except for the requirement that the cavities be separated by 0.25 inches to allow for compression of scrap material between adjacent cavities. Because the prior art embodiment is limited by the requirement for a 0.25 inch gap between cavities, it can be seen in FIG. 1A that only four cavities can fit across the width of the substrate. Accordingly, a large amount of substrate area, and therefore material, is wasted. In FIG. 2A, a gap 42 of only 0.0625 inches is used between cavities according to the present invention. With the smaller gap 42, it is possible to fit a fifth cavity in the width 44 of the substrate. In this example, it is clear that the use of smaller gaps between cavities can have a large effect on the utilization of material, and on the speed and efficiency of cutting operations.

Figure 2B:
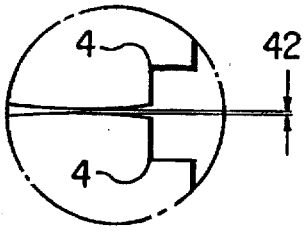
FIG. 2B is a detailed view taken within circle 2B of FIG. 2A.
Figure 4:
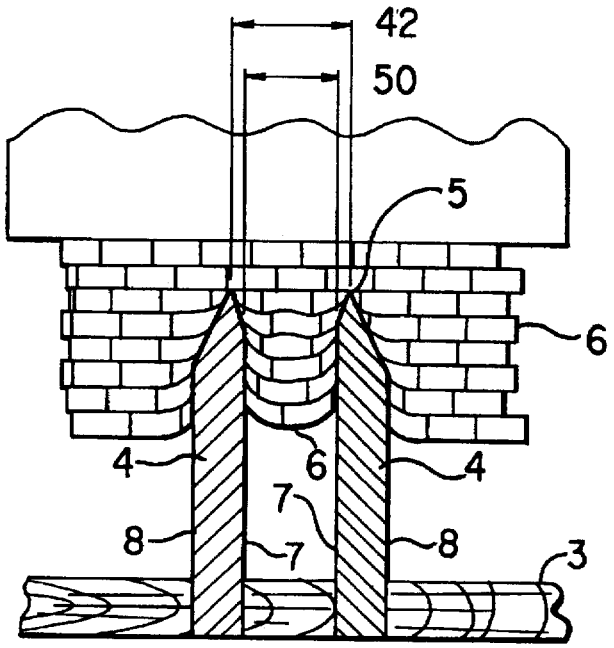
FIG. 4 is a sectional view taken along line 4—4 of FIG. 2A.

It is apparent from FIGS. 2A, 2B, and 4, adjacent cavities can each include adjacent linear portions of rule which are parallel to each other, and that the cutting edges 5 of the parallel linear portions can be separated by a gap 42 of less than 0.25 inches.

Figure 3:
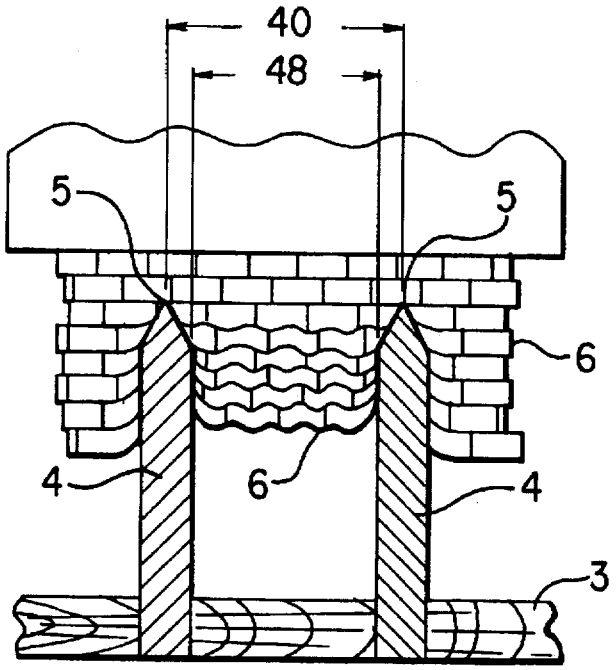
FIG. 3 PRIOR ART
FIG. 3 is a sectional view taken along line 3—3 of FIG. 1A.

FIG. 3 shows the rule of adjacent cavities using the industry typical 0.25 inches gap 40 between cavities. The cutting edges or tips 5 on rule 4 are thus spaced apart by gap 40 of 0.25 inches. If the typical rule 4 has a width or thickness of 0.085 inches, the material 6 being cut is compressed between the two cavities from the gap 40 of 0.25 inches to a rule segment spacing 48 of 0.165 inches. The material is therefore compressed by 34%. If the rule 4 of adjacent cavities were moved closer to each other than the gap 40 of 0.25 inches, the material 6 would be compressed by a higher percentage. Many in the industry accept that 0.25 inches is the closest the rule can be moved together.

The present invention uses offset bevel rule as shown in FIG. 4 to reduce the amount of material that is compressed between the rule of adjacent cavities. Offset bevel rule can be purchased from National Steel Rule Company of Linden, N.J. The offset bevel rule used is shown in more detail in FIG. 5. The rule 4 may have some similar qualities to the center bevel rule shown in FIG. 3. For example, a thickness t of 0.085 inches, the height, and a material of alloy steel may be used. One difference between offset bevel rule and center rule is in the placement and type of its cutting edge. The rule used in the present invention is preferably serrated as can be seen looking at the side of a section of rule in FIG. 6. In FIG. 6 the rule 4 can be seen to have serrations 36. Each serration 36 should be arcuate in shape with a concave portion of each serration pointing towards the cutting edge of the rule 4. The rule preferably includes 11–14 serrations per inch of length.

Figure 5:
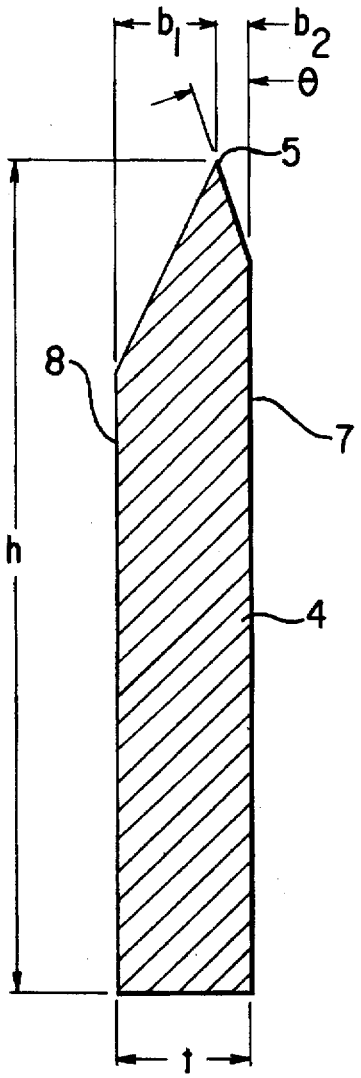
FIG. 5 shows the offset bevel rule of the present invention.
Figure 6:
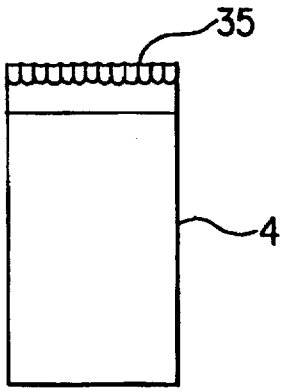
FIG. 6 shows the serrated blade of the rule used in the present invention.

The rule can be seen in FIG. 5 to have a thickness t with a cutting edge or tip 5 that is displaced from the geometric center of the thickness of the rule. Side 7 of the rule 4 is situated towards the outside of a cavity in the die. Side 8 of the rule 4 is situated towards the inside of a cavity in the die. Between the cutting tip 5 and the inner side 8 of the rule there is a major bevel which has a dimension in the plane of the thickness of $b_1$. Between the cutting tip 5 and the outer side 7 of the rule there is a minor bevel which has a dimension in the plane of the thickness of $b_2$. The major bevel dimension $b_1$ is preferably between 65% to 95% as wide as the thickness t of the rule. In one preferred embodiment, the major bevel dimension $b_1$ is 86% as wide as the rule. The slope of the minor bevel forms an angle θ to vertical as shown in FIG. 5. The slope θ of the minor bevel may be any angle between 20°–35°, but is preferably 27°. The minor bevel is used to increase the strength of the rule. The larger the dimension $b_2$ of the minor bevel, the stronger the rule will be. However, increasing the dimension $b_2$ of the minor bevel also compresses the cut material between cavities by a larger amount, and so the cavities may need to be spaced by a larger gap. The exact position of the cutting tip 5 and the exact relative dimensions of the major bevel $b_1$ and the minor bevel $b_2$ are dependent on the particular application. The amount of offset to be used in the rule is influenced by the type and thickness of material being cut and the size and shape of patterns being cut.

Referring to FIG. 4, the lengths of rule of adjacent cavities can be seen to have their outer sides 7 facing each other. Therefore the minor bevels $b_2$ of the two lengths of rule also face each other. The material 6 between the adjacent cavities is compressed by the amount of two times the dimension $b_2$ of the minor bevel. In the example shown, the cutting tips 5 of the two lengths of rule are spaced by 0.0625 inches, and the dimension $b_2$ of the minor bevel of the rule is 0.012 inches. Therefore, the spacing 50 between the side surfaces 7 of the adjacent rule 4 facing each other, this spacing 50 may hereinafter be referred to as the rule segment spacing, is 0.0385 inches (i.e., 0.0625 inches minus two times 0.012 inches), and the material 6 between the cavities is compressed from 0.0625 inches to 0.0385 inches. This is a compression of the material by 38%. If the minor bevel of the rule is smaller, the gap between cavities can be smaller. If the minor bevel of the rule is larger, the gap between the cavities must be larger. It has been found that gaps between cavities of 0.0625 to 0.1875 inches are preferred.

Additionally, it is recognized that the present invention permits the efficiency of numerous cavity shapes and configurations to be maximized. For example, one such configuration can provide adjacent portions of rule in adjacent cavities wherein the cutting edges of the adjacent portions of rule are separated by a gap of less than 0.25 inches at two spaced apart locations and are separated by a gap of more than 0.25 inches in areas between the spaced apart locations.

Figure 7:
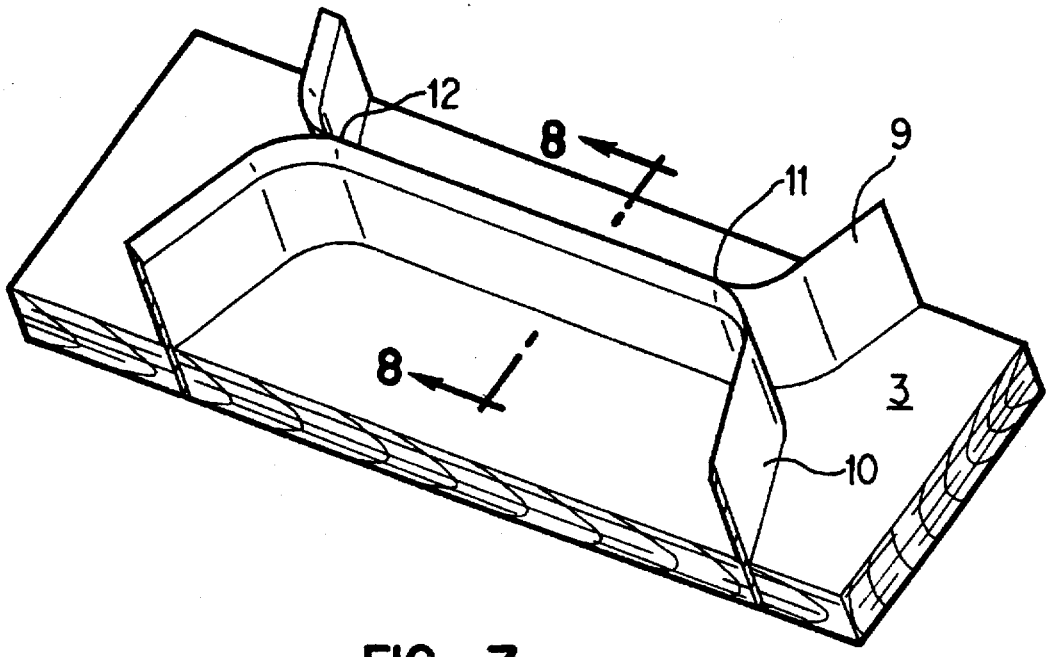
FIG. 7 is a perspective view showing two adjacent cavities in contact with each other.
Figure 8:
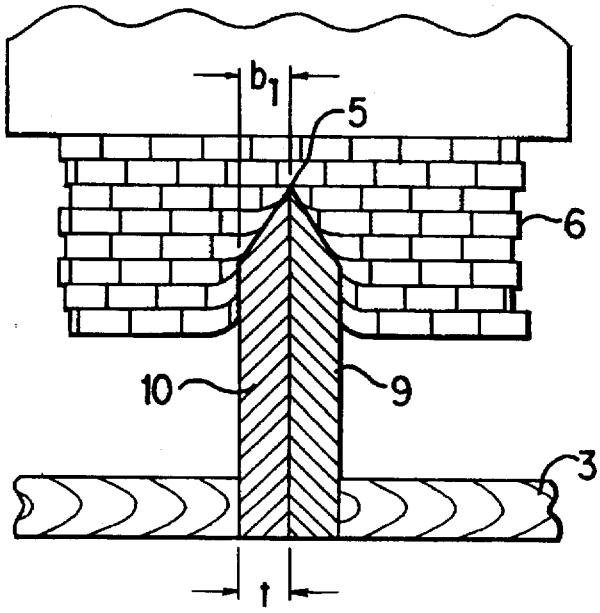
FIG. 8 is a sectional view taken along line 8—8 of FIG. 7.

In certain applications it may be possible to eliminate the minor bevel of the rule entirely, i.e., make the dimension $b_2$ equal to zero. With no minor bevel, the dimension $b_1$ of the major bevel is equal to the thickness t of the rule. This type of rule is herein referred to as side bevel rule. By using side bevel rule the gap between cavities can be completely eliminated and adjacent cavities can butt up against each other. FIGS. 7 and 8 show a portion of a die with side bevel rule being used to eliminate the gap between cavities. The rule of a first cavity 9 and the rule of an adjacent second cavity 10 can be seen to converge at points 11 and 12. Between points 11 and 12 the lengths of rule of cavities 9 and 10 are touching and there is no gap between the cavities. The common section of rule can be joined by a variety of techniques such as welding, silver soldering, brazing, riveting, or a combination of these. The cavities 9 and 10 can touch each other over a section of common rule as shown in FIG. 7 or they can touch at a single point and then diverge again immediately. In this way the gap can be eliminated between cavities of any geometry.

FIG. 8 shows a cross section of the rule of adjacent cavities 9, 10 in the area that they touch each other. The rule can be seen to have a dimension $b_2$ of the major bevel that is the same as the thickness t of the rule. Therefore the cutting tips 5 of the rule are at the outside edges of the rule. When the two sections or rule touch each other the cutting tips 5 of the two sections substantially coincide with each other. The two sections of rule therefore can function as a section of center bevel rule with twice the thickness of rule. It can be seen that the material 6 is compressed only into the interior of each cavity and no material is compressed between the two sections of rule.

The arrangement in FIG. 8 can also be achieved by using offset bevel rule in which the portions of adjacent rule are removed such that in adjacent contacting areas the minor bevel is zero. This arrangement provides the additional advantages of having lengths of rule with enhanced strength in the areas which do not contact each other.

The choice of whether to use offset bevel rule to reduce the gap between adjacent cavities or to use side bevel rule to completely eliminate the gap between cavities is a dependent on the particular application. The choice may be influenced by the type and thickness of material being cut and the size and shape of patterns being cut. The use of offset bevel rule and side bevel rule are not mutually exclusive. Indeed, in many applications, a combination of offset bevel rule and side bevel rule may be the most appropriate choice. In this case some adjacent cavities could have a reduced gap between them and other adjacent cavities could have no gap between them.

Figure 9:
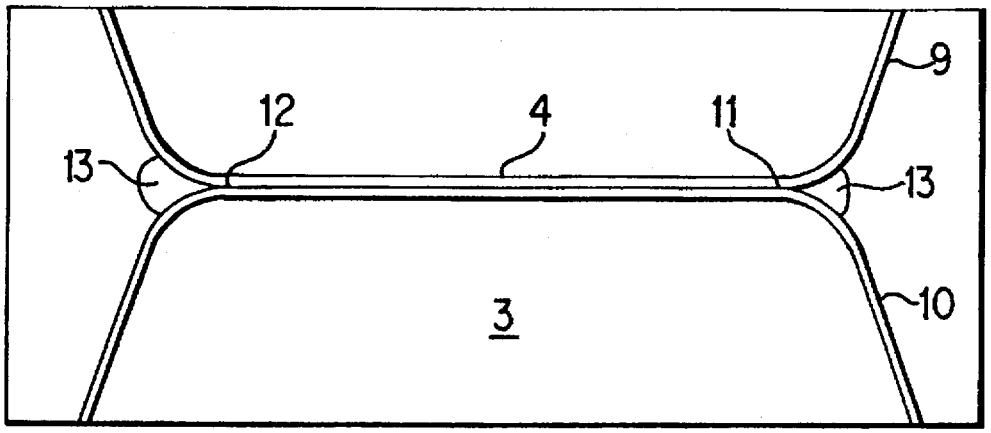
FIG. 9 is a plan view of a section of die with the substrate removed in the areas where two sections of rule are diverging.
Figure 10:
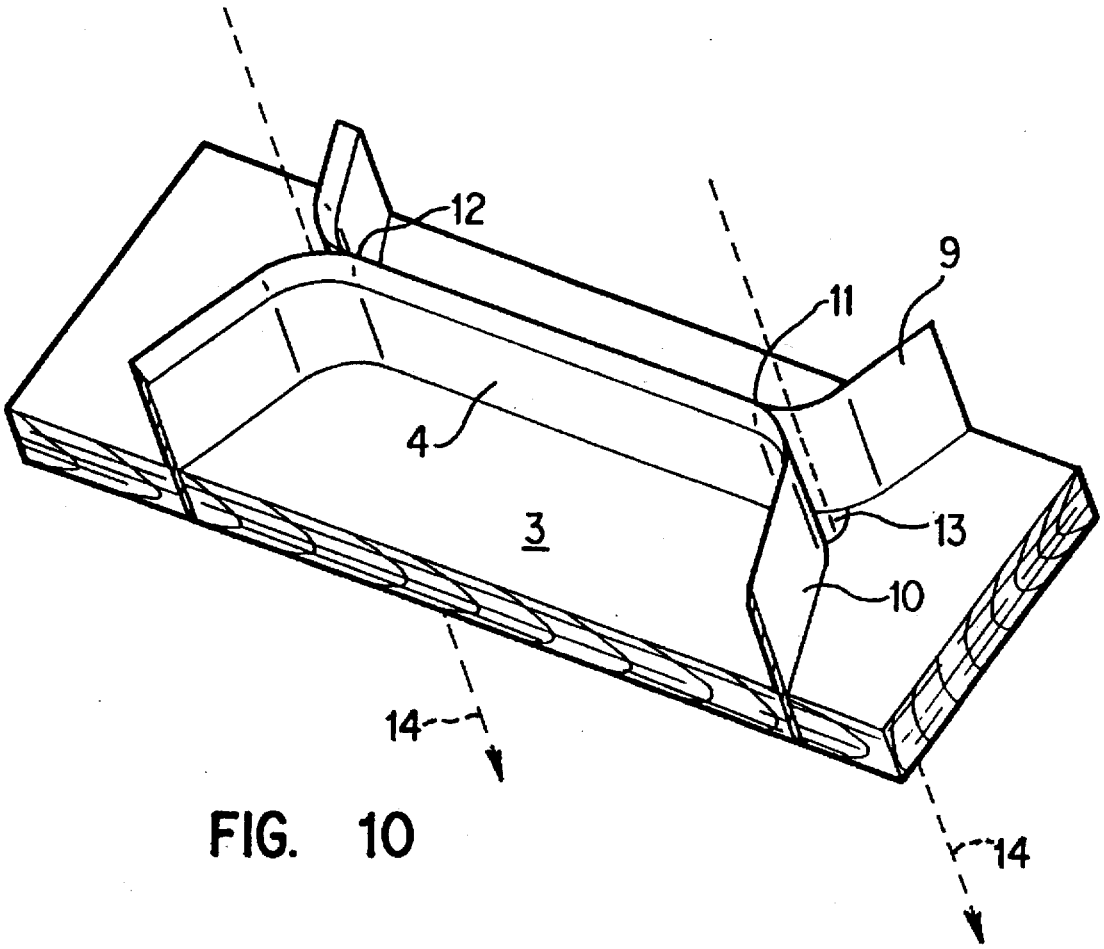
FIG. 10 is a perspective view of FIG. 9.

If side bevel rule is used to eliminate the gap between adjacent cavities, provisions should be utilized to prevent small, scraps of material getting caught between the rule of adjacent cavities, especially if the two cavities diverge at a small angle. One aspect of the present invention relieves this problem by removing the substrate in areas where the lengths of rule of two adjacent cavities diverge at a small angle. FIG. 9 shows a portion of a die where two adjacent cavities 9, 10 converge to touch each other and then diverge again. The adjacent cavities 9, 10 touch each other at points 11, 12 and immediately adjacent the points 11, 12 the lengths of rule of cavities 9, 10, form a small angle relative to each other. In the area where the lengths of rule of adjacent cavities form a small angle a portion of the substrate 3 has been removed to form holes 13. As shown by arrows 14 in FIG. 10, the material scraps that would normally become wedged in the small crevices between adjacent cavities can now pass through the holes 13 and be ejected out the back side of the substrate 3.

In many applications, it may be desired or necessary to make marker notches in the pattern of one or more cavity of the die. Marker notches put notches in the resulting cut piece of material. The marker notches are used in assembling the material into finished products. Sometimes the marker notches may be used to mark the location of a fold in the material. Other times, if two pieces of material are to have a long seam sewn between them there may be corresponding marker notches in each of the two pieces so that the notches can be aligned during sewing to assure that the pieces are properly aligned. The marker notches are usually small triangular shaped cutouts along the periphery of the pattern. If a marker notch is be placed in an area where the gap between adjacent cavities has been reduced or eliminated, then some allowance should be made for evacuation of the extra scrap material created by the notch.

Figure 11:
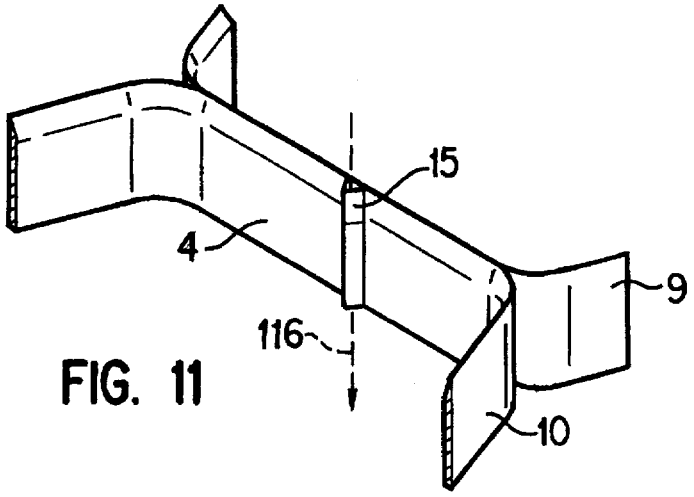
FIG. 11 is a perspective view of a section of rule with a first embodiment of marker notch formed therein.

FIG. 11 shows one embodiment of a marker notch formed in the rule. In FIG. 11, two sections of rule 4 from two adjacent cavities 9, 10 touch each other along one section. In the middle of this section, the rule 4 of cavity 10 has a marker notch 15 formed therein. Marker notch 15 is merely a triangular shaped bend formed in the rule 4. In this embodiment the marker notch 15 is formed over the entire height of the rule 4 so that the space between cavities 9 and 10 form a triangular shaped cylinder at the marker notch 15. An extra scrap of material will be formed by marker notch 15 and there should be provision for evacuating that scrap. In this embodiment, the substrate 3 of the die is removed in an area corresponding to the cross section of marker notch 15. As indicated by arrow 116 the scrap material can now pass through the substrate 3 and be ejected out of the back of the die.

Figure 12:
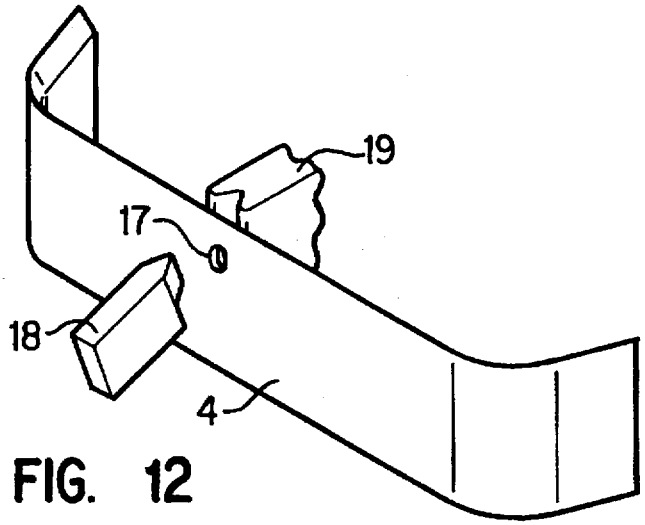
FIG. 12 is a perspective view illustrating the process for forming a second embodiment of marker notch.
Figure 13:
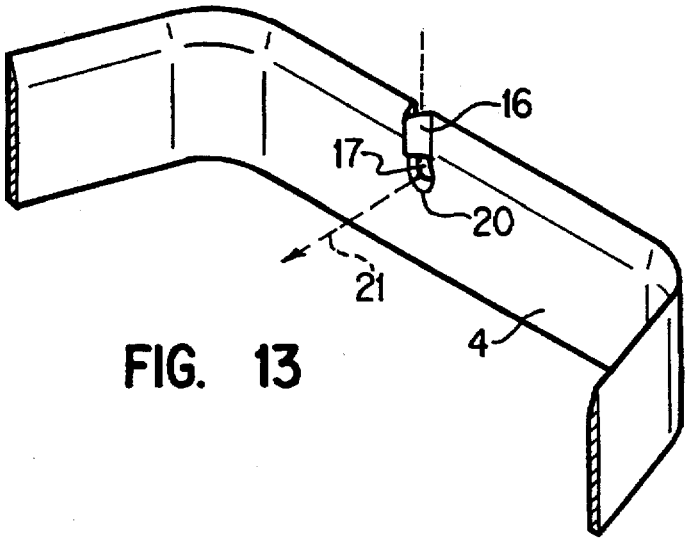
FIG. 13 is a perspective view of a section of rule with the second embodiment of marker notch formed therein.

A second embodiment of marker notch is shown in FIGS. 12 and 13. Here the marker notch 16 is formed only in the top portion of the rule 4. Before forming the notch 16 in the rule 4, a hole 17 is drilled in the rule at the bottom extent of the marker notch. After drilling the hole 17 in the rule 4 a notch 16 is stamped into the portion of the rule that is above hole 17. The notch 16 is stamped into rule 4 by forcing dies 18 and 19 together over the portion of the rule above hole 17. Die 18 is a male die and die 19 is a female die and both dies are of the shape of notch 16. Male die 18 forces the rule 4 into the female die 19 so that the rule takes the shape of the notch 16. In stamping the notch 16 into rule 4, it is preferred that the male die 18 be moved with an upward movement so that the rule 4 remains at the same height over notch 16 and does not dip downwardly. The die 18 is preferably made with an irregular edge so that it can bite into the rule and not slide over the rule. After the notch has been formed in the rule the bottom of the hole 17 is ground at an angle to form a bevel 20 on the bottom of the hole. The bevel 20 allows scrap material to evacuate through the hole 17 as shown by arrow 21.

Figure 14:
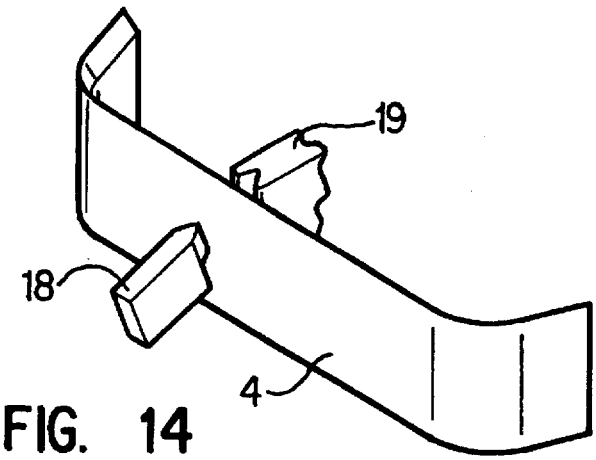
FIG. 14 is a perspective view illustrating the process for forming a third embodiment of marker notch.
Figure 15:
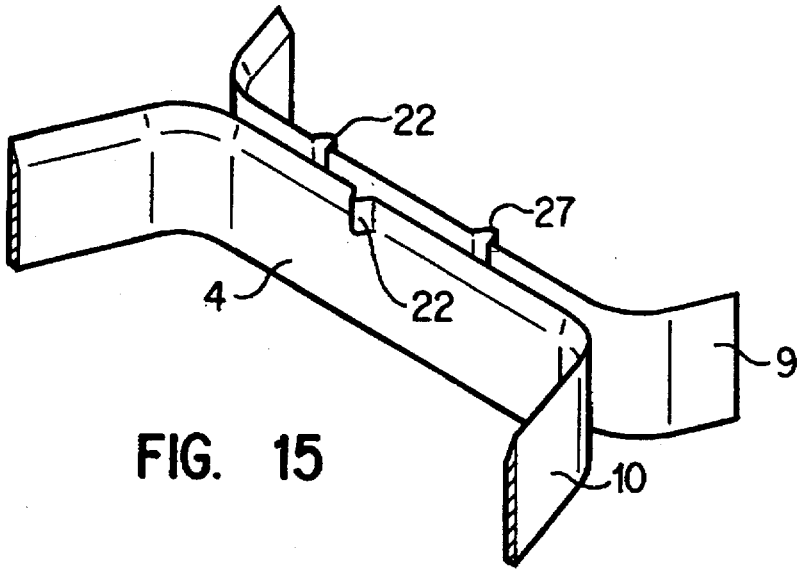
FIG. 15 is a perspective view of a section of rule with the third embodiment of marker notch formed therein.

If the rule 4 of adjacent cavities 9, 10 do not touch each other, it is possible to form a third type of marker notch. The third embodiment of marker notch is shown in FIGS. 14 and 15. In this embodiment the rule 4 does not get a hole drilled in it as described above. Rather a notch 22 is formed in the top portion of a solid rule 4. The notch 22 is formed by stamping between two dies 18, 19 as described above. When marker notches of this type are used in sections of adjacent cavities 9, 10, the marker notch material will compress into the gap between cavities. It may be necessary to use a slightly larger gap between adjacent cavities 9, 10 when using this type of marker notch.

Figure 16:
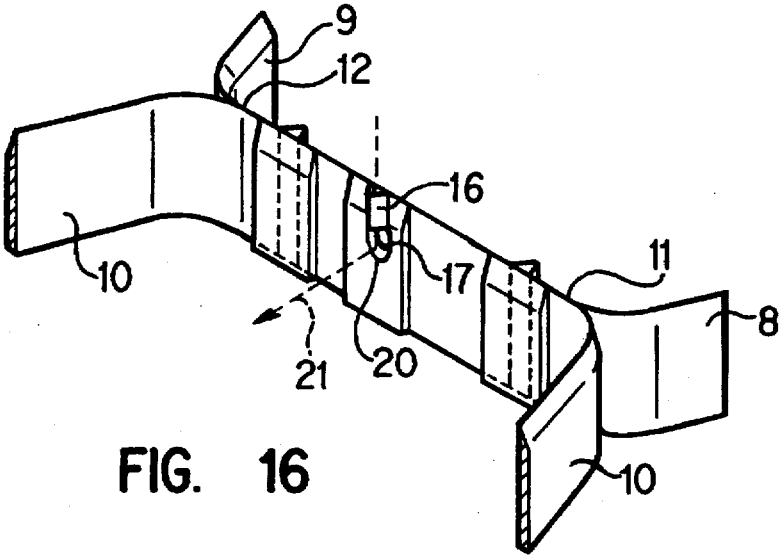
FIG. 16 is a perspective view of a section of rule with a fourth embodiment of marker notch formed therein.

If there are long straight sections between adjacent cavities, it may be desirable to use a single piece of rule to define the common border of the two cavities as shown in FIG. 16. The lengths of rule of cavities 9, 10 can be joined at intersection points 11, 12 and a single piece of rule used in between. If a marker notch is to be placed in the area of common rule, then a small piece of rule with a notch 16 formed therein can be attached to the long stretch of single rule at the appropriate locations. The notch 16 in this embodiment is preferably the type described in the second embodiment of marker notch above. The marker notch preferably has a scrap evacuation hole 17 with a bevel 20 on the bottom thereof so that scrap material can escape as shown by arrow 21.

Figure 17:
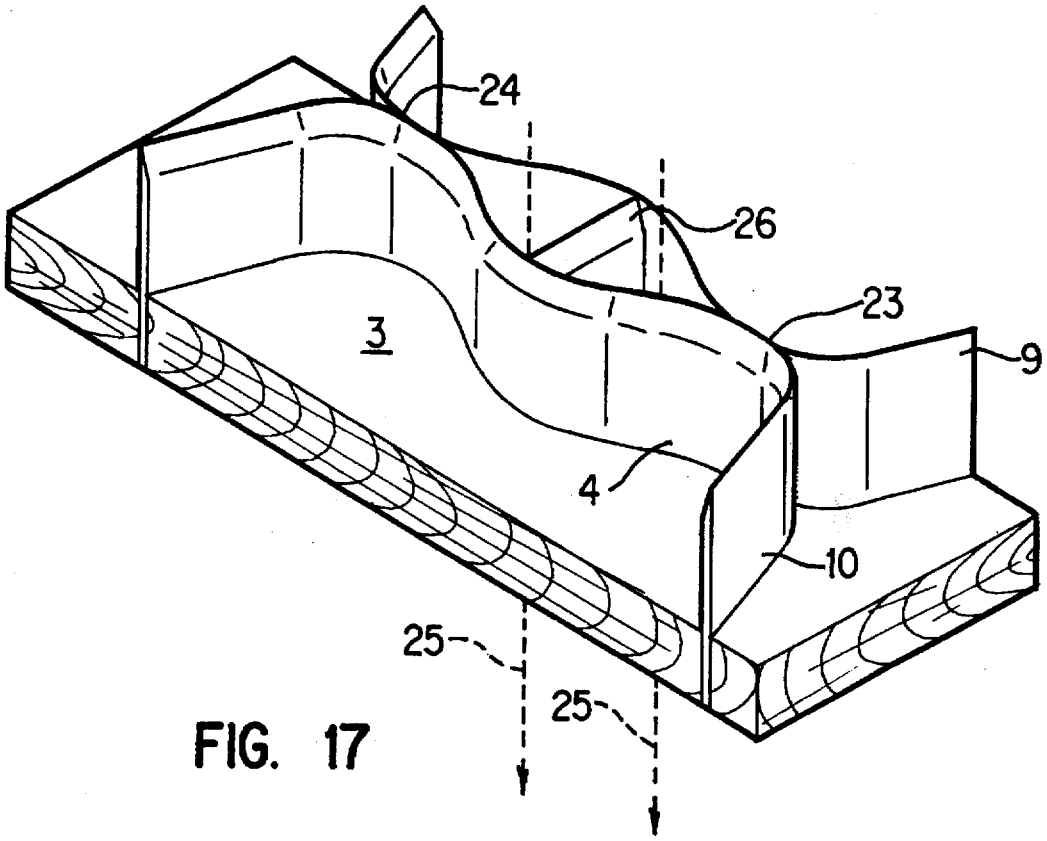
FIG. 17 is a perspective view showing two adjacent cavities with a wandering gap.

One of the advantages of the present invention is its ability to adapt to complex shapes of cavities. Adjacent cavities can converge for long straight sections, a single point of contact, or have wandering gaps where two adjacent sections come into and out of contact with each other. FIG. 17 illustrates a wandering gap where the rule 4 of adjacent cavities come into contact with each other at two points 23, 24 and diverge again between points 23, 24. In the gap between points 23, 24, the substrate 3 should be removed to allow scrap material to be evacuated through the back of the die as shown by arrows 25. If the gap between points 23, 24 is long and/or wide, the rule 4 of cavities 9, 10 may be weakened in the area of the gap because the removed substrate can not support the rule. Therefore, it may be desirable to join an extra piece of rule 26 to the rule of cavities 9, 10. The extra piece of rule 26 forms a bridge to strengthen the rule of cavities 9, 10. Extra rule 26 also serves to cut scrap material into smaller pieces for easier evacuation. Bridges should preferably be placed every 3 to 6 inches along the gap between adjacent cavities.

Figure 18:
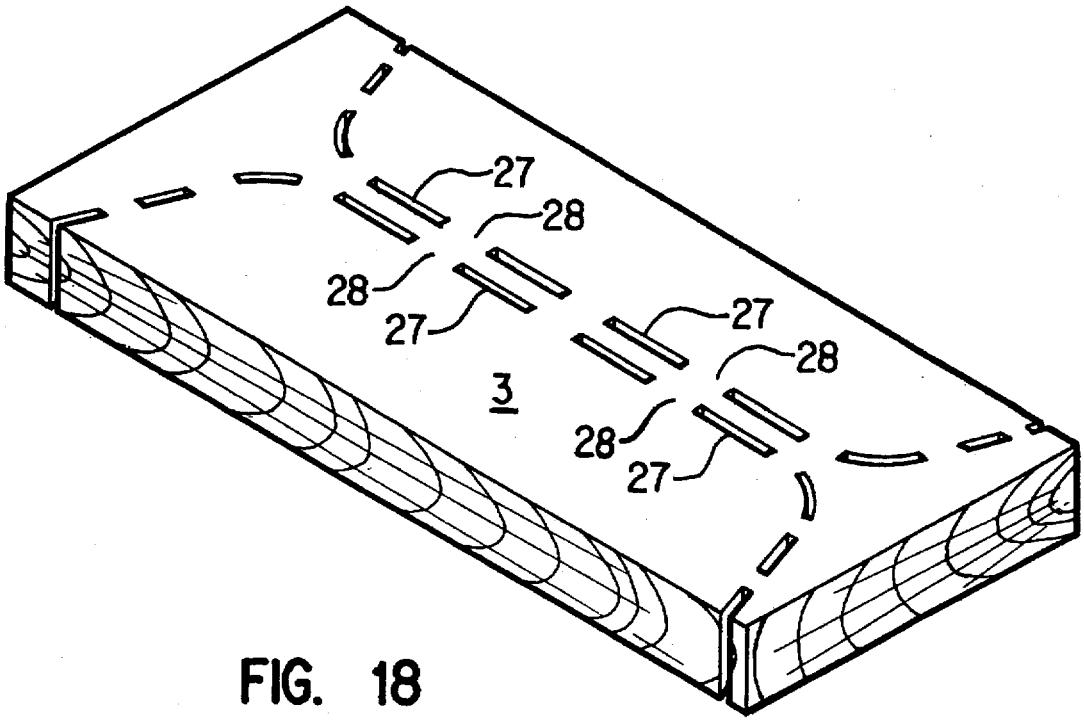
FIG. 18 is a perspective view of a section of substrate with a groove formed therein for attaching the rule.

The steel rule 4 is attached to the substrate 3 of the die by cutting a slot 27 in the substrate and inserting the rule into the slot in the substrate. The slot 27 cannot be cut along the entire periphery of the cavities or the substrate in the middle of the cavities would not be supported and would fall out. Therefore the slots 27 should be cut intermittently as shown in FIG. 18. The gaps between portion of slot 27 are known as bridges 28. Where two sections of adjacent cavities are closely spaced according to the present invention, it is important that the bridges 28 of adjacent cavities be aligned with one another. By so aligning the bridges 28 of adjacent cavities, the strength and integrity of the substrate 3 is maintained. If the bridges 28 of adjacent cavities are not aligned when the cavities are in close proximity to each other the substrate will likely be weakened along the slots and could crack or split.

Figure 19:
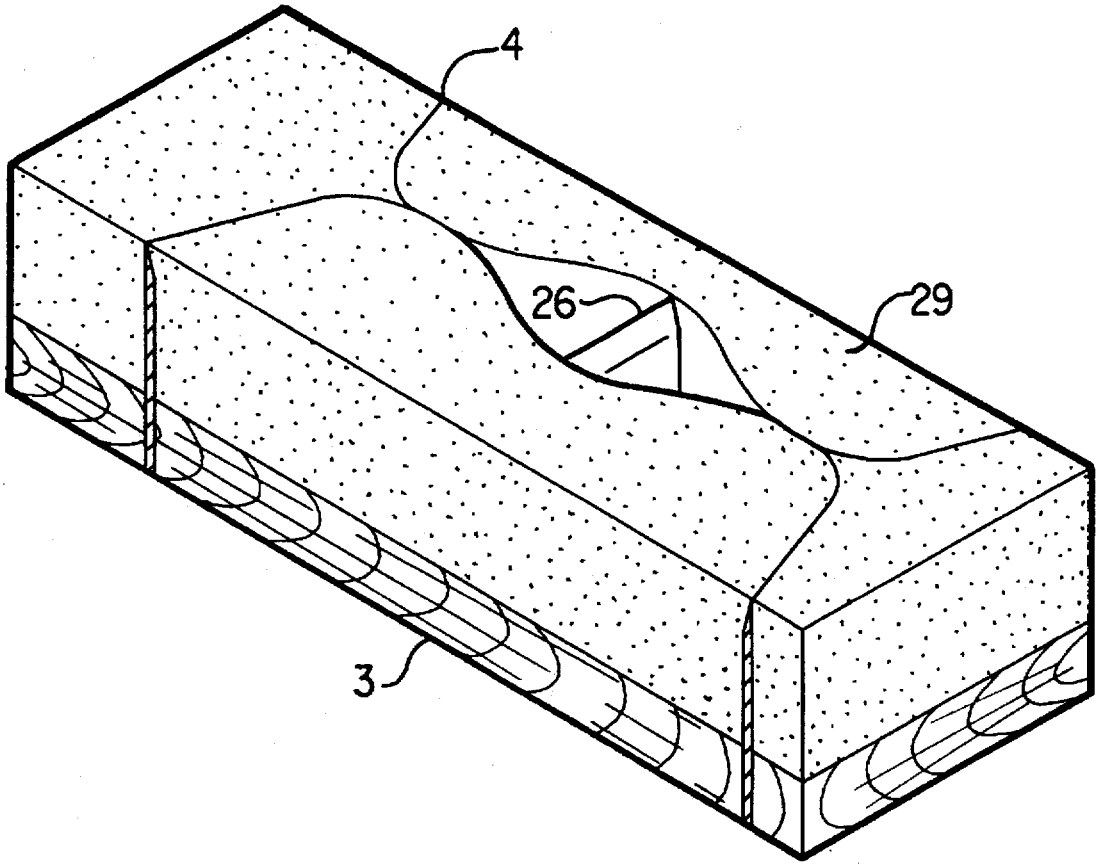
FIG. 19 is a perspective view showing a portion of the die of the present invention with ejection foam used therein.

FIG. 19 shows the die of the present invention with ejection foam mounted thereon to facilitate removal of material from the die after it has been cut. The die is the same as described above with sections of rule 4 inserted into slots in substrate 3 to form die cavities. The difference is that foam 29 has been attached to the substrate 3 by an appropriate technique. Foam 29 is compressible so that it is compressed as material is cut by rule 4. After the material has been cut, the foam 29 expands to its original shape and forces the material out of the die. This makes removal of material from the die easier and speeds up the cutting process. It has been found that both open and closed cell foam with an Indentation Force Deflection (IFD) between 130 & 165 yields acceptable results. When portions of the substrate have been removed to allow material to pass through the back of the substrate, no ejection foam is used on those portions.

It is preferable that the slots be cut very precisely into the substrate. In conventional dies, the slots are cut in the substrate with the center of the slot defining the shape of the cavities. Because of the offset bevel of the rule used in the present invention, the slots should be offset by a small amount. The small offset in the location of the slots allows the cutting edge of the rule to define the proper shape of the cavity. In order to cut the slots in exactly the proper position on the substrate, it may be necessary to cut the slots to within a precision of ±0.010 inches. This precision may be very difficult to achieve with conventional manual cutting techniques. In prior embodiments, slots are typically cut into the substrate by drilling a hole in the substrate, inserting a jigsaw blade into the hole, and manually cutting the slot with a jigsaw. However, not only does the conventional manual cutting process lack the desired accuracy, but the drilling of a starting hole to allow the jigsaw blade to be inserted weakens the substrate. In areas where two cavities are close to each other, the starting hole may extend all the way into the slot of the adjacent cavity further weakening the substrate. In order to cut slots accurately in the substrate without need to drill starting holes, an automated cutting set-up is proposed.

Figure 20:
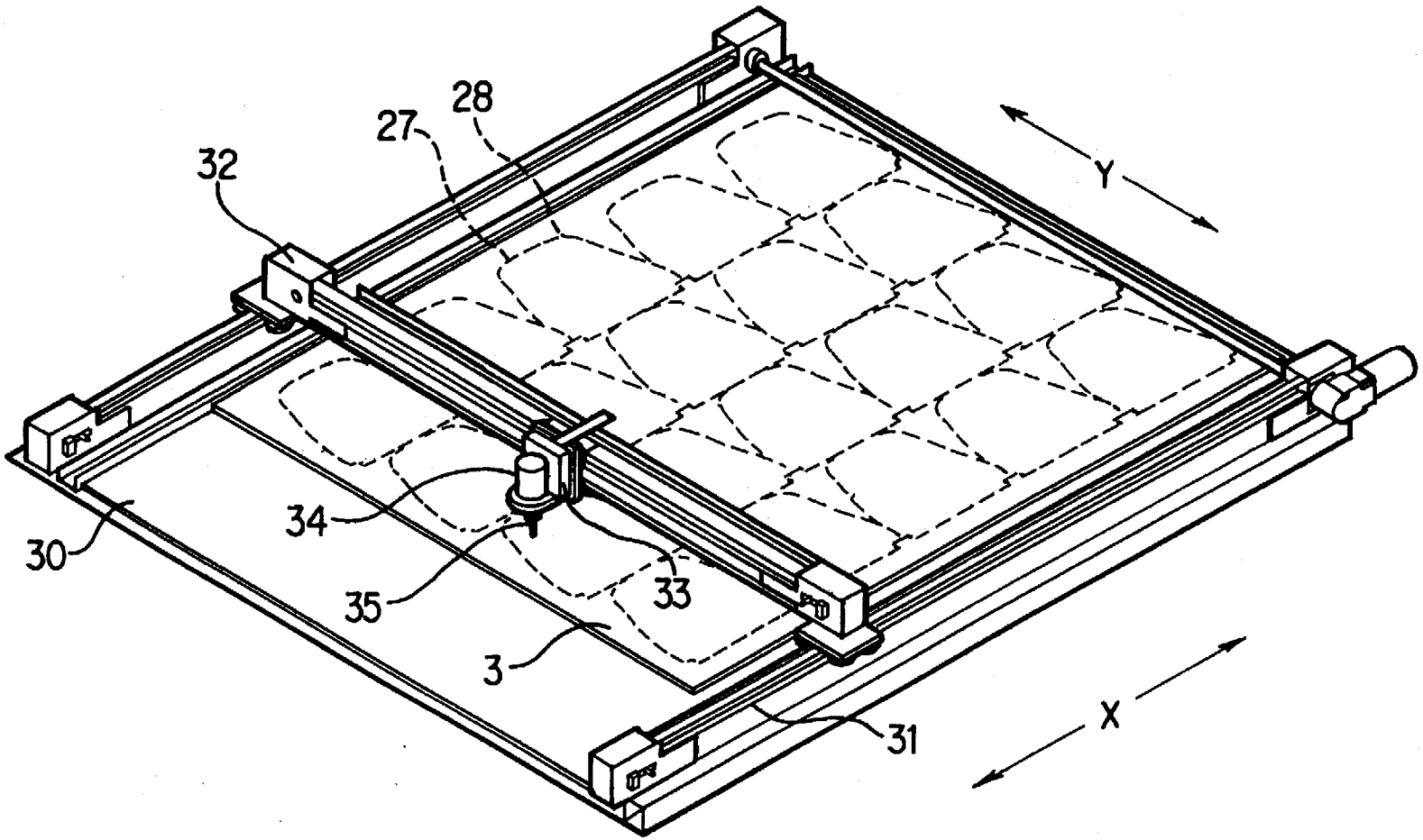
FIG. 20 is a perspective view of the cutting system used to cut slots in the substrate of the present invention.

FIG. 20 shows the automated cutting apparatus used to cut slots in the substrate. The cutting apparatus has a cutting table 30 onto which a substrate 3 is laid. An X-Y cutting system is mounted on the table 30. The X-Y cutting system consists of a pair of side rails 31 fixedly mounted to the sides of the table 30 with their longitudinal axes extending in the X direction as shown in FIG. 20. A gantry 32 extends between the side rails 31. The gantry is supported on the rails 31 by wheels or other structure that allow the gantry to move back and forth in the X direction along rails 31. The gantry's longitudinal axis extends in the Y direction as shown in FIG. 20. A mounting device 33 is movably mounted to gantry 32 so as to be able to move in the Y direction along gantry 32. The mounting device 33 is also capable of reciprocating motion in a vertical direction so as to be able to extend and retract the cutter. Attached to mounting device 33 is the slot cutter which consists of a spindle motor 34 and a cutting tip 35. When spindle motor 34 is activated, the cutting tip 35 spins and is capable of cutting slots 27 in substrate 3. The motion of the gantry 32 on the side rails and the motion of mounting device 31 on the gantry 32 are computer controlled. By controlling these two motions simultaneously, it is possible to cause the cutting tip 35 to traverse any desired path and cut the slots 27 in the desired pattern in substrate 3. By moving the mounting device 33 downwardly to extend the cutting tip 35 the slots 27 will be cut in the substrate 3. If the mounting device 33 is moved upwardly the cutting tip 35 will be retracted and no slot will be cut in the substrate 3. In this way it is possible to cut slots 27 in some locations while leaving bridges 28 intact in other locations.

Accordingly, a multi-cavity die has been presented in which the gap between adjacent cavities can be reduced from the frequently used 0.25 inches, to as little as 0.0625 inches, or even eliminated in some applications. Complex shapes of cavities can be accommodated with the present invention. Allowance has been made for evacuation of scrap material out of the back of the die in areas of tight crevices between cavities or in marker notches. Because individual cavities can be used without need to attach the rule of adjacent cavities along common sections, cleaning and repair of the die is easily facilitated. The die is simple and inexpensive to fabricate and is rugged and durable in use.

While preferred embodiments of the invention have been shown and described, it will be apparent to those skilled in the art that various modifications may be made in these embodiments without departing from the scope of the invention. Therefore, it is intended that the invention not be limited to the particular embodiments disclosed but that the scope of the invention be defined by the following claims.

What is claimed is:

1. A die comprising:

a substrate;

a plurality of lengths of rule structurally coupled to said substrate, each length of rule defining a cavity by forming the periphery thereof, each of the cavities having an inside within its respective length of rule and an outside beyond its respective length of rule;

each said length of rule having a first end structurally coupled to the substrate and a second end opposite the first end, said second end having a cutting edge, each said length of rule further including an inner side disposed adjacent the inside of its respective cavity, an outer side disposed adjacent the outside of its respective cavity, and a geometric center substantially bisecting the length of rule between the inner side and the outer side of the length of rule, said cutting edge being disposed outwardly from the geometric center of said length of rule with respect to its respective cavity and intermediate the geometric center and the outer side of its respective length of rule; and wherein said plurality of cavities include adjacent first and second cavities, wherein the length of rule of said first cavity includes a first portion of role and the length of rule of said second cavity includes a second portion of rule adjacent to and spaced from the first portion of the length of rule of the first cavity, wherein the cutting edges of said first and second potions are separated by a gap of less than 0.25 inches.

2. The die of claim 1 wherein the gap between said cutting edges of the first and second portions of rule is within a range of 0.0625 to 0.1875 inches.

3. The die of claim 1 wherein each said length of rule has a thickness defined as the distance between its inner side and its outer side, and its cutting edge is disposed at a position spaced from said inner side towards said outer side by a length within the range of 65% to 95% of its thickness.

4. The die of claim 3 wherein the cutting edge is disposed at a position spaced from said inner side towards said outer side by a length which is substantially 86% of its thickness.

5. The die of claim 1 wherein one of said lengths of rule has a marker notch formed in said one length of rule, said marker notch is formed only in a top portion of said one length of rule adjacent the cutting edge, said one length of rule having a bottom portion located below said marker notch and adjacent said substrate which is undeformed and void of marker notches.

6. The die of claim 5 wherein said one length of rule has a hole therein immediately beneath said marker notch to allow cut material to pass therethrough.

7. The die of claim 1 wherein each said length of rule includes a height defined as the vertical distance on the length of rule from the substrate to its cutting edge, said die further comprising a compressible member mounted to said substrate and extending to a height substantially equal to the height of each said length of rule, and wherein said compressible member having an Indentation Force Deflection between 130 to 165 pounds.

8. The die of claim 1 wherein the substrate is removed between said two spaced apart lengths of rule locations to allow material to pass through the substrate.

9. The die of claim 1, wherein said first end of each said length of rule is directly fixedly mounted to said substrate.

10. The die of claim 9, wherein said substrate includes slots formed therein, said first end of each said length of rule is embedded into said slots.

11. The die of claim 1, wherein said first and second portions of rule are linear, parallel, and spaced apart.

* * * * *

UNITED STATES PATENT AND TRADEMARK OFFICE

CERTIFICATE OF CORRECTION

PATENT NO. : 5,676,032
DATED : October 14, 1997
INVENTOR(S) : Michael J. Johnson It is certified that error appears in the above-indentified patent and that said Letters Patent is hereby corrected as shown below:

Column 12, line 24, delete the word "role" and substitute therefor --rule--.

Column 12, line 28, delete the word "potions" and substitute therefor --portions--.

Signed and Sealed this

Thirtieth Day of December, 1997

*Attest:*

*Attesting Officer*

BRUCE LEHMAN

*Commissioner of Patents and Trademarks*

US005676032C1

(12) EX PARTE REEXAMINATION CERTIFICATE (6025th)

United States Patent
Johnson

(10) Number: US 5,676,032 C1
(45) Certificate Issued: Dec. 4, 2007

(54) STEEL RULE DIE WITH CLOSELY NESTED CAVITIES

(75) Inventor: Michael J. Johnson, El Paso, TX (US)

(73) Assignee: Ontario Die International Inc., Kitchener, Ontario (CA)

Reexamination Request:
No. 90/006,248, Mar. 15, 2002

Reexamination Certificate for:

| | |
|---|---|
| Patent No.: | **5,676,032** |
| Issued: | **Oct. 14, 1997** |
| Appl. No.: | **08/545,929** |
| Filed: | **Oct. 20, 1995** |

Certificate of Correction issued Dec. 30, 1997.

(51) Int. Cl.
*B26F 1/44* (2006.01)
*B26F 1/38* (2006.01)

(52) U.S. Cl. ..... 83/697; 83/55; 83/698.91; 83/652; 83/97

(58) Field of Classification Search ..... 83/697, 83/55, 698.91, 652, 97, 695, 684, 685, 911, 83/683, 682; 225/97
See application file for complete search history.

(56) References Cited

U.S. PATENT DOCUMENTS 3,411,208 A 11/1968 Malm ..... 83/692
4,981,061 A 1/1991 Hillock et al. ..... 83/697
5,129,295 A 7/1992 Geffros et al. ..... 83/19

OTHER PUBLICATIONS

Seminar "More Profit from Press Cutting" presented by J.S. Bastable, Samco–Strong Limited, Leicester, England, 1983.

Advertisement "Diemaking Supplies".

Except from Article "Packaging Productivity", Jan. 1993.

*Primary Examiner*—Boyer D Ashley

(57) ABSTRACT

A steel rule cutting die for cutting fixed patterns in a single or plurality of stacked material layers according to the shape of the steel rule. The invention provides for a decrease in the quantity of scrap material produced, by minimizing the amount of gap between adjacent cavities in the steel rule cutting die. Pre-sharpened steel rule is used with the cutting edge shifted to the outboard side of the cavity thus reducing the amount of compression or wedging of scrap material between adjacent cavities, and thus allowing adjacent cavities to be positioned closer to one another or to contact one another without reducing the ability to remove the scrap material after the cutting operation. Frayed scrap material can be evacuated through the base of the die by providing evacuation holes in the base substrate of the die as well as providing for evacuation of scrap material from marker notch locations along joined sections of adjacent cavities. A variety of cavity shapes can be accommodated.

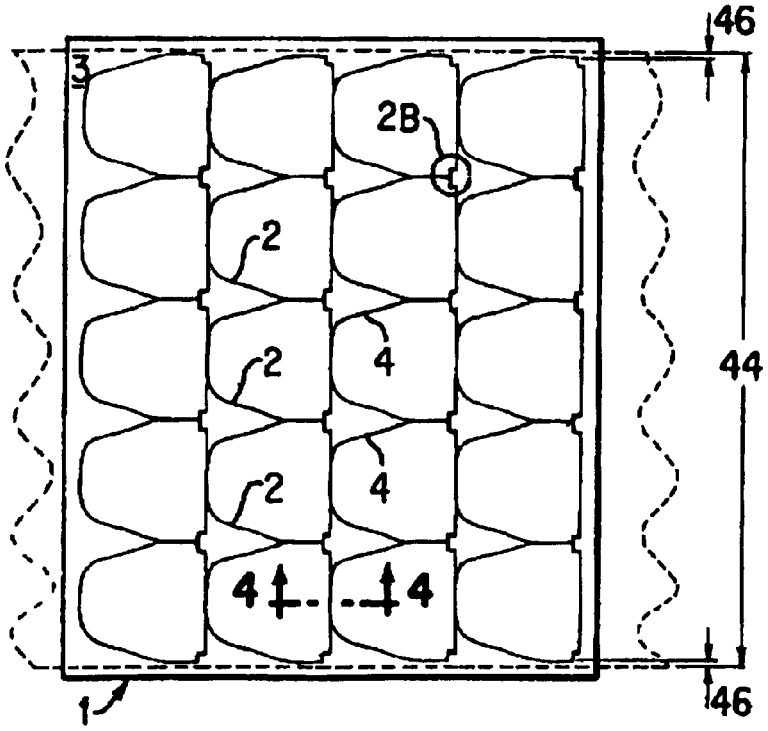

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 6 is confirmed.

Claims 1–5 and 7–11 are cancelled.

* * * * *